United States Patent [19]

Bowerman et al.

[11] 4,107,858

[45] Aug. 22, 1978

[54] ATHLETIC SHOE HAVING LATERALLY ELONGATED METATARSAL CLEAT

[75] Inventors: William J. Bowerman; Stanley L. James; Dennis E. Vixie, all of Eugene, Oreg.

[73] Assignee: BRS, Inc., Beaverton, Oreg.

[21] Appl. No.: 787,888

[22] Filed: Apr. 15, 1977

[51] Int. Cl.[2] ..... A43B 5/00; A43B 13/04; A43C 15/00

[52] U.S. Cl. ..... 36/134; 36/32 R; 36/67 R

[58] Field of Search ..... 36/134, 59 R, 59 C, 36/67 R, 67 A, 67 D, 32 R

[56] References Cited

U.S. PATENT DOCUMENTS

| | | | |
|---|---|---|---|
| 1,559,086 | 10/1925 | Golden | 36/67 D |
| 2,095,766 | 10/1937 | Shapiro | 36/134 |
| 2,678,507 | 5/1954 | Dye | 36/134 |
| 3,063,171 | 11/1962 | Hollander | 36/134 |
| 3,127,687 | 4/1964 | Hollister et al. | 36/134 |

FOREIGN PATENT DOCUMENTS

| | | | |
|---|---|---|---|
| 534,628 | 3/1922 | France | 36/67 D |
| 320,029 | 10/1929 | United Kingdom | 36/67 D |
| 313,716 | 6/1929 | United Kingdom | 36/67 A |

*Primary Examiner*—Patrick D. Lawson
*Attorney, Agent, or Firm*—Klarquist, Sparkman, Campbell, Leigh, Hall & Whinston

[57] ABSTRACT

An athletic shoe is described with an outer sole having a laterally elongated matetarsal cleat of resilient material molded integral with such outer sole. The metatarsal cleat extends laterally across the entire width of the toe portion of the sole in a position immediately behind the heads of the metatarsal bones of the wearer's foot. In one embodiment the metatarsal cleat is in the form of a curved chevron including two wing shaped side portions each having curved front and rear surfaces to provide good longitudinal traction and self-cleaning action under wet condition. In additon, the chevron cleat is provided with two end portions and an intermediate porton having straight edges extending longitudinally to provide greater lateral traction. A plurality of other cleats of different shape and smaller ground engaging surface area than the metatarsal cleat are also molded integral with the outer sole. These other cleats are of a straight sided polygon shape, such as a hexagon or square, and are of the same height as the metatarsal cleat. The athletic shoe is for use in sports such as soccer, football or baseball, requiring quick lateral movement as well as longitudinal movement, on natural grass turf or synthetic plastic turf.

17 Claims, 8 Drawing Figures

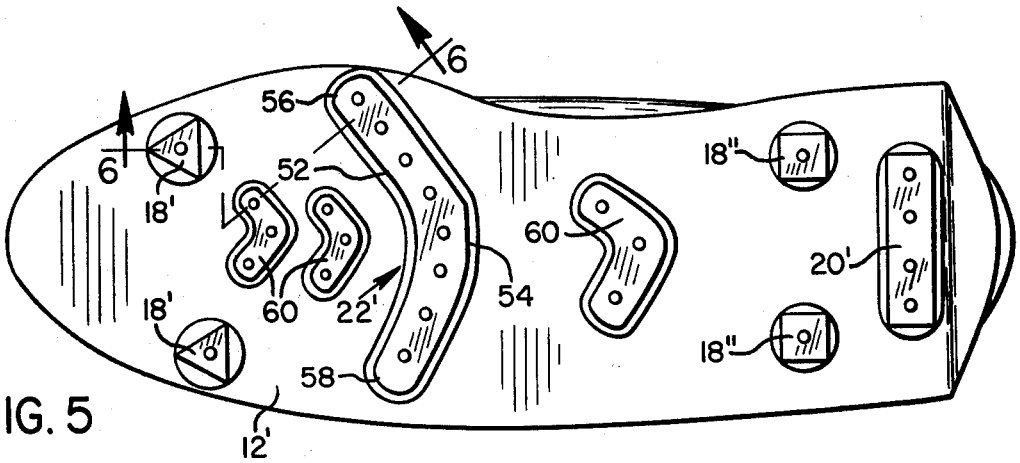
FIG. 5
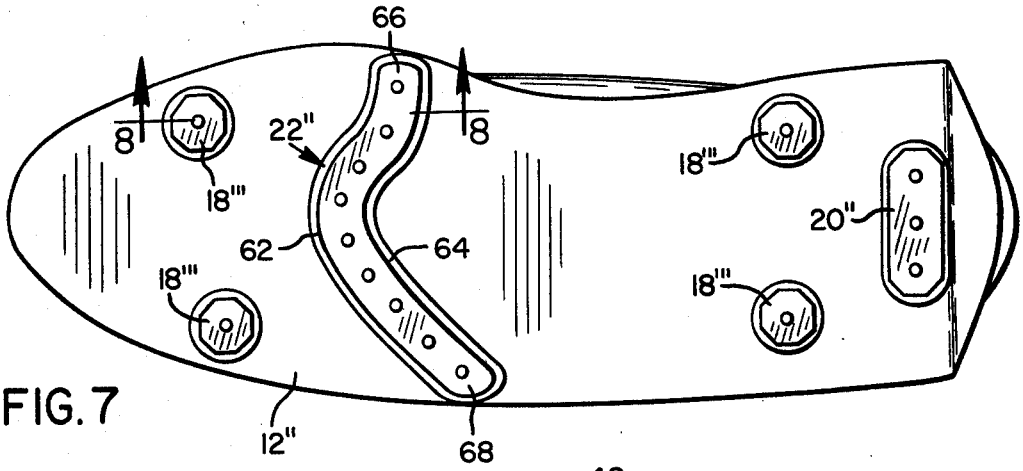
FIG. 7
FIG. 4
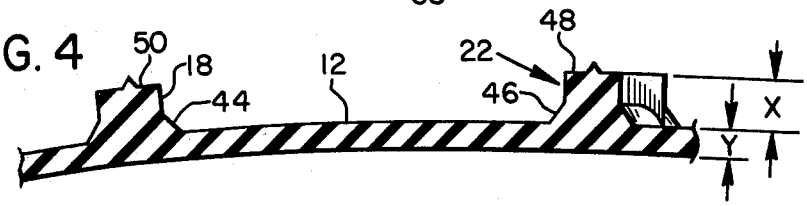
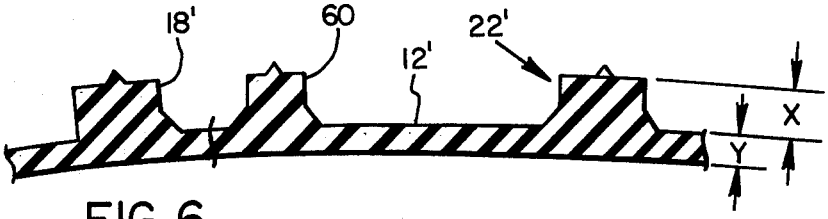
FIG. 6
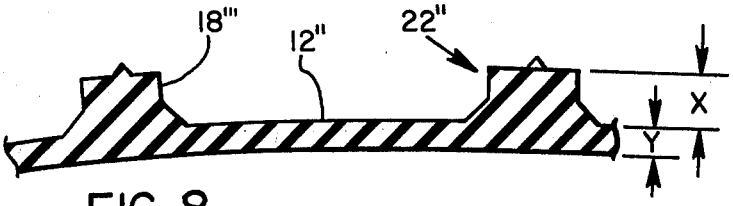
FIG. 8

ATHLETIC SHOE HAVING LATERALLY ELONGATED METATARSAL CLEAT

BACKGROUND OF INVENTION

The subject matter of the present invention relates generally to athletic shoes having cleated soles, and in particular to such soles in which the cleats are made of resilient material molded integral with the outer sole including a laterally elongated metatarsal cleat that is self-cleaning and provides good traction for movement in both longitudinal and lateral directions. The metatarsal cleat extends laterally across substantially the entire width of the toe portion of the sole in a position immediately behind the heads of the metatarsal bones of the foot of the wearer for improved traction.

The cleated sole of the present invention is especially useful on athletic shoes for sports such as soccer, football or baseball played on natural grass turf or artificial turf which require quick lateral movement as well as longitudinal movement. The lateral elongated metatarsal cleat is self-cleaning, and does not become clogged with dirt or grass on natural turf while at the same time providing good traction under wet or dry conditions. In addition, the shoe sole of the present invention is also suitable for use on artifical turf under wet or dry conditions because the metatarsal cleat has a squeegee-like action in removing water from the turf and channeling it outward to the outside edges of the sole to prevent the water from flowing rearwardly under the heel and thereby provides improved stopping traction. In addition, since the cleats are molded of resilient material integral with the outer sole, they provide improved cushioning for artificial turf and other hard surfaces. Added cushioning is provided by a midsole layer of foam rubber or foam plastic beneath such outer sole.

Previously it has been proposed in U.S. Pat. No. 2,888,756 of Parsons, granted June 2, 1959, to provide a cleated sole for football shoes having self-cleaning cleats molded integral with the outer sole. However, none of these cleats extend substantially entirely across the width of the toe portion of the sole so they do not channel water and dirt outward toward the side edges of the sole and fail to prevent such water from flowing beneath the heel. Also, they are not positioned immediately behind the metatarsal bone heads. In addition, the cleats are not made of a resilient material but of a rigid plastic material called Neolite, and are provided with a triangular cross section forming a sharpened edge at the bottom of such cleats. As a result, such sole is not suitable for use on natural and artificial turf.

It has also been proposed in U.S. Pat. No. 3,793,750 of W. J. Bowerman, granted Feb. 26, 1974, to provide an athletic shoe having an improved cleated sole for use on artifical turf in which the cleats are made of resilient material molded integral with the outer sole. While this sole is suitable for use on both natural and artificial turf, under some wet conditions it can become clogged with mud and grass.

Previous athletic shoes which avoided the clogging problem of natural grass have used a plurality of widely spaced cleats, usually of a frusto-conical shape, which are unsuitable on artificial turf under wet conditions because of the hydro-planing effect achieved with such cleats, such as when a player attempts to stop suddenly after running rapidly in a forward direction. The hydro-planing effect is produced when a thin film of water is formed beneath the cleats, thereby causing them to lose traction with the grass or artificial turf of the playing field. These two problems of clogging and hydro-planing are both avoided by the sole of the present invention with its lateral elongated metatarsal cleat.

SUMMARY OF INVENTION

It is therefore one object of the present invention to provide an improved athletic shoe suitable for natural or artificial turf having a cleated outer sole which is self-cleaning and provides good traction in the longitudinal and lateral directions.

Another object of the invention is to provide such an improved sole employing a laterally elongated metatarsal cleat extending across substantially the entire width of the toe portion of the sole.

A further object is to provide such a sole in which the metatarsal cleat acts to channel water, mud, grass and other material outward toward the side edges of the sole for improved traction.

An additional object of the invention is to provide such an improved sole in which the cleats are of resilient material molded integral with the sole and provided with substantially flat ground engaging surfaces for improved cushioning and traction on artificial turf.

Still another object of the present invention is to provide such a sole having a plurality of toe and heel cleats which are of a different shape and have a smaller ground engaging surface than the metatarsal cleat but of substantially the same height as the metatarsal cleat in order to provide additional traction and cushioning.

Still another object of the present invention is to provide such an improved sole in which the lateral elongated metatarsal cleat is positioned immediately behind the heads of the metatarsal bones of the foot of the wearer for greater transfer of force from the foot to the ground.

DRAWINGS

Other objects and advantages of the present invention will be apparent from the following detailed description of certain preferred embodiments thereof and from the attached drawings of which:

FIG. 4 is a section view taken along the line 4—4 of FIG. 2;

FIG. 5 is a bottom plan view of a cleated outer sole in accordance with a second embodiment of the present invention;

FIG. 6 is a section view taken along the line 6—6 of FIG. 4;

FIG. 7 is a bottom plan view of a cleated outer sole in accordance with a third embodiment of the invention; and FIG. 8 is a section view taken along the line 8—8 of FIG. 7.

DESCRIPTION OF PREFERRED EMBODIMENTS

Figure 1:
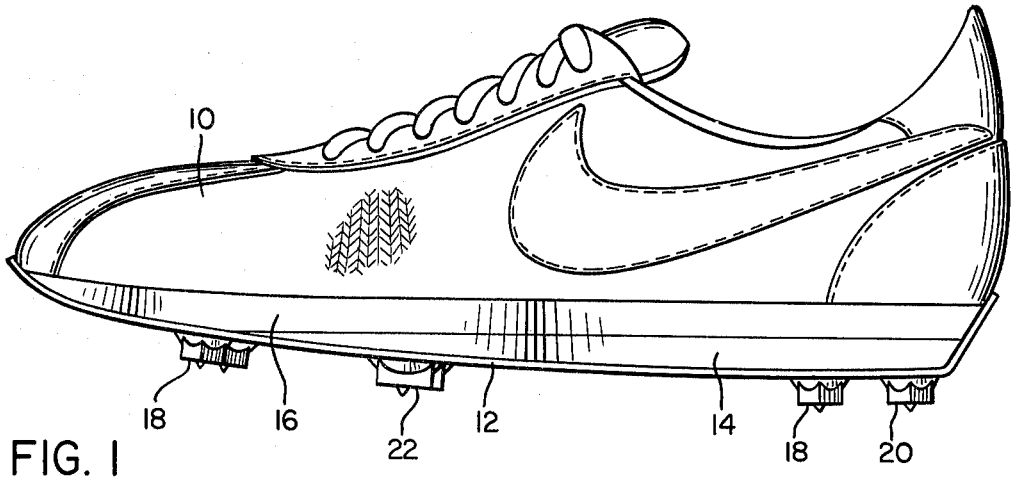
FIG. 1 is a side elevation view of an athletic shoe having a cleated sole in accordance with one embodiment of the present invention.
Figure 2:
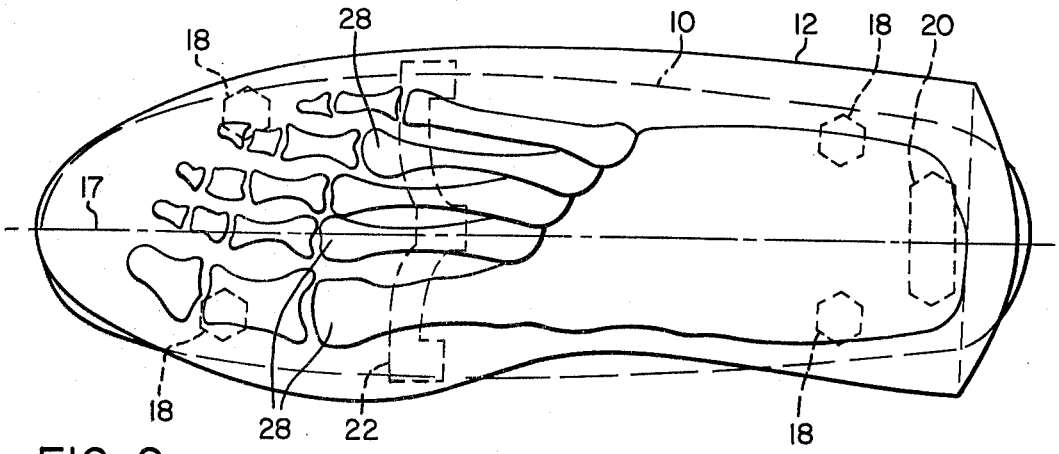
FIG. 2 is a top plan view of the shoe of FIG. 1 with the shoe upper removed to show the position of the foot relative to the cleats.
Figure 3:
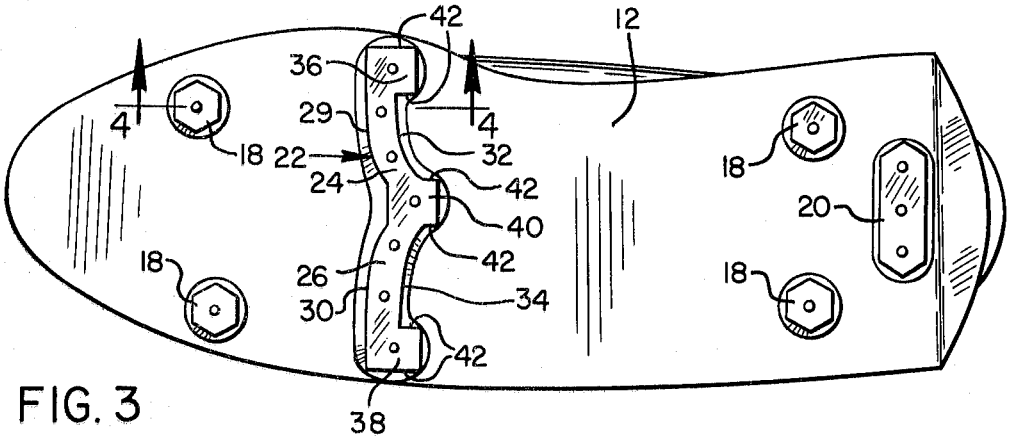
FIG. 3 is a bottom plan view of the shoe of FIG. 1 showing the cleated outer sole.

As shown in FIGS. 1, 2 and 3, one embodiment of an athletic shoe made in accordance with the present invention includes a shoe upper 10 joined to a multi-layered sole including a cleated outer sole 12, a heel lift sole layer 14 and a cushioning intermediate sole layer 16. The heel lift layer 14 and the intermediate sole layer 16 are positioned between the outer sole 12 and the shoe upper 10. However, the heel lift layer 14 and intermediate sole layer 16 may be reversed from the positions shown in FIG. 1 so the heel lift layer is on top of the intermediate sole layer. The outer sole 12 is made of a rubber or other resilient material. Such outer sole is harder and more wear resistant than the midsole layers 14 and 16, which are primarily for cushioning. The heel lift layer 14 also raises the heel of the wearer's foot to prevent injury to the Achilles tendon during running. The midsole layers 14 and 16 are normally made of foam rubber or of foamed artificial plastic material, of lower density than the outer sole layer.

The shoe upper 10 may be made of leather or synthetic plastic fabric including the three layer sandwich construction shown in U.S. Pat. No. 3,793,750. The shoe is preferably made with a flat shoe last whose last axis 17 bisects the heel bone and extends through the head of the second metatarsal bone of the wearer's foot, as shown in FIG. 2.

The outer sole 12 has a plurality of straight sided polygon shaped cleats 18 of resilient material molded integral with the outer surface of the toe and heel portions of such outer sole. These polygon shaped cleats including two toe cleats and two heel cleats on opposite sides of the sole may be in the form of hexagons, squares, triangles or other polygons having straight sides for increased traction. In addition, an elongated heel cleat 20 of resilient material is molded integral with the heel portion of the outer sole, such heel cleat having a length extending laterally across the sole a distance about three times the maximum width of the polygon cleats 18. The heel cleat 20 is positioned beneath the heel bone of the wearer's foot adjacent the rear edge of the heel portion of the outer sole and is spaced behind two polygon heel cleats 18 provided on opposite sides of such heel portion.

A laterally elongated metatarsal cleat 22 of resilient material is molded in a curved chevron shape integral with the toe portion of outer sole 12. The metatarsal cleat 22 is provided under the ball of the foot and extends laterally across substantially the entire width of the toe portion of such outer sole. The metatarsal cleat 22 is positioned immediately behind the heads of the metatarsal bones 28 of the wearer's foot for maximum efficiency in the transfer of force from the foot to the ground through such cleat. The metatarsal cleat includes two wing shaped side portions 24 and 26 on opposite sides of the longitudinal axis of the sole which corresponds to the shoe last axis 17. The inner side portion 24 extends from the center to a point adjacent to the inside edge of the shoe sole while the outer side portion 26 extends from the center to a point adjacent the outside edge of such sole.

The chevron shaped metatarsal cleat 22 is provided with two rearwardly curved front surfaces 29 and 30 and two rearwardly curved rear surfaces 32 and 34 on side portions 24 and 26, respectively. These curved surfaces act as deflectors to channel the water, mud and grass outwardly toward the edges on opposite sides of the shoe sole. In addition, the curved front surfaces 29 and 30 and curved rear surfaces 32 and 34 of the metatarsal cleat provide good traction for longitudinal movement in the forward or backward direction. In order to give additional traction for lateral movement, a pair of end portions 36 and 38 are provided at the opposite ends of the metatarsal cleat 22 along with an intermediate portion 40 between the side portions 24 and 26. Each of these end portions and intermediate portion have straight longitudinally extending sides 42 which engage the ground during lateral movement for improved traction.

In addition to the chevron cleat 22 the polygon cleats 18 on both the toe and heel portions of the sole provide traction in the longitudinal and lateral directions. It should be noted that the outside toe cleat 18 is positioned slightly behind the inside toe cleat 18. However, the two heel cleats 18 are in lateral alignment.

As shown in FIG. 4, cleats 18 are of the same height, X, as the metatarsal cleat 22 and heel cleat 20, which is typically between $\frac{1}{4}$ inch and $\frac{3}{8}$ inch. The height, X, of the cleats is at least twice the thickness, Y, of the uncleated portion of the outer sole surrounding such cleats, such uncleated portion being about $\frac{1}{8}$ inch thick. As shown in FIG. 3, the cleats 18 each taper outwardly from the main body of the cleat at its base where it joins the outer sole, to provide a sloped annular base surface 44 for greater strength and self-cleaning. A similar sloped base portion 46 is provided on the metatarsal cleat 22 and the heel cleat 20 completely surrounding such cleats.

As shown in FIG. 4, the metatarsal cleat 22 and the polygon cleats 18 both have substantially flat ground engaging surfaces 48 and 50, respectively, as does the heel cleat 20. The ground engaging surface 48 of the metatarsal cleat 22 is of much greater area than the ground engaging surface 50 of each of the polygon shaped cleats 18. In addition, the cross sections of both the polygon cleats 18 and the chevron cleat 22 are of a substantially rectangular shape as shown in FIG. 4 to provide the flat ground engaging surfaces so they are suitable for artificial turf and other hard surfaces.

The heel cleat 20 is also of a straight sided polygon shape, similar to a rectangle but having flattened corners to provide semi-hexagonal opposite ends. The heel cleat 20 is elongated in a lateral direction so that its length is at least twice the maximum width of the polygon cleats 18. As stated above the heel cleat 20 is positioned beneath the heel bone of the wearer's foot for greater traction on starting, stopping and changing direction. In addition, on artificial turf it is believed that the channeling action of the metatarsal cleat 22 will prevent water from flowing backward from such metatarsal cleat beneath the heel portion of the sole. This will prevent hydroplaning and provide greater stopping traction for the heel cleats under wet conditions.

As shown in FIGS. 5 and 6, another embodiment of the cleated outer sole 12' of the present invention includes a pair of triangular shaped polygon toe cleats 18' and a pair of square shaped polygon heel cleats 18'' in place of the hexagonal cleats 18 of FIG. 3. In addition, the laterally elongated metatarsal cleat 22' is of a generally crescent shape, rather than the curved chevron shape of metatarsal cleat 22 in FIG. 3. Furthermore, the elongated heel cleat 20' is of a rectangular shape slightly different than the heel cleat 20 of FIG. 3, whose corners are flattened.

The crescent metatarsal cleat 22' has a forwardly curved concave front surface 52 and a forwardly curved convex rear surface 54 which extends between an inner end portion 56 and an outer end portion 58, positioned adjacent the inside and outside edges, respectively, of the toe portion of the outer sole. It should be noted that the inside end portion 56 is positioned slightly ahead of the outside end portion 58 a distance greater than the width of the metatarsal cleat 22'. However, the metatarsal cleat 22' is still behind the heads of the overlying metatarsal bones. Also, the modified metatarsal cleat 22' extends across substantially the entire width of the toe portion of the outer sole to channel water outward to the opposite sides of the sole and prevent water from flowing rearwardly from the metatarsal cleat beneath the heel portion of the sole.

In addition, the outer sole of FIG. 5 also includes three V-shaped cleats 60, two of which are positioned in front of the modified metatarsal cleat 22' between the two triangular toe cleats 18'. One of the V-shaped cleats is provided under the arch portion of the sole between the metatarsal cleat 22' and the two square heel cleats 18''. These three V-shaped cleats provide additional traction and are self-cleaning like the remaining cleats.

A third embodiment of the cleated sole 12'' of the present invention is shown in FIGS. 7 and 8. This sole is similar to that of FIGS. 3 and 4 except that it employs a different metatarsal cleat 22'' which is shaped like a modified question mark. This metatarsal cleat 22'' has a convex front surface 62 and a concave rear surface 64 which are curved oppositely from those of the crescent metatarsal cleat 22'. In addition, metatarsal cleat 22'' includes a substantially straight inside end portion 66 which extends laterally to the inside edge of the sole. The opposite end 68 of the metatarsal cleat extends to the outside edge of the sole at a position spaced behind the other end portion 66 a distance slightly greater than the width of such metatarsal cleat. However, the metatarsal cleat 22'' of FIG. 7 is otherwise similar to that of FIG. 3 in that it extends across substantially the entire width of the toe portion of the sole and is of the same height but has a larger flat ground engaging surface area than the octagon cleats 18'''.

It will be obvious to those having ordinary skill in the art that many changes may be made in the abovedescribed preferred embodiment of the present invention without departing from the spirit of the invention. For example, other shapes may be employed for the metatarsal cleat. Therefore, the scope of the present invention should only be determined by the following claims.

We claim:

1. An athletic shoe in which the improvement comprises:

an outer sole having a plurality of spaced cleats of resilient material molded integral with said outer sole under the toe and heel portions of the shoe;

said cleats including an elongated lateral cleat extending laterally across substantially the entire width of the toe portion of said sole;

said cleats each having a substantially flat ground engaging bottom surface and including a plurality of other toe cleats of smaller ground engaging surface area than said lateral cleat, said other toe cleats being positioned in front of said lateral cleat, substantially the same height as said lateral cleat, and spaced from each other laterally across the width of said sole.

2. A shoe in accordance with claim 1 in which the lateral cleat is a metatarsal cleat which extends laterally behind the heads of the metatarsal bones of the wearer's foot and includes a curved intermediate portion between the opposite ends of said lateral cleat.

3. A shoe in accordance with claim 2 in which the lateral cleat is of a curved chevron shape including two side portions on opposite sides of the longitudinal axis of the sole, said side portions have rearwardly curved front and rear surfaces.

4. A shoe in accordance with claim 3 in which the chevron cleat also includes end portions at the ends of said side portions, said end portions having straight edges at least some of which extend longitudinally of the sole.

5. A shoe in accordance with claim 4 in which the chevron cleat includes an intermediate portion at the junction between the two side portions, which includes additional straight longitudinal edges.

6. A shoe in accordance with claim 2 in which the lateral cleat is of a generally crescent shape with a concave curved front surface and a convex curved rear surface.

7. A shoe in accordance with claim 6 in which one end of the lateral cleat adjacent the inside edge of the outer sole is positioned ahead of the opposite end of the lateral cleat adjacent the outside edge of said outer sole.

8. A shoe in accordance with claim 6 in which the other toe cleats include triangular toe cleats and V-shaped toe cleats positioned ahead of the lateral cleat and each being of smaller ground engaging surface area than said lateral cleat.

9. A shoe in accordance with claim 1 in which the other toe cleats are of different shape than said lateral cleat but are of substantially the same height and all of said cleats having a substantially rectangular cross section taken perpendicular to the bottom surface of said outer sole.

10. A shoe in accordance with claim 9 in which said other cleats have bottom surfaces which are straight sided polygons.

11. A shoe in accordance with claim 9 in which said other cleats have hexagonal bottom surfaces.

12. A shoe in accordance with claim 1 in which an intermediate sole layer of greater thickness, less hardness and lower density than said outer sole is provided between the shoe upper and said outer sole.

13. A shoe in accordance with claim 1 in which the heel portion of the outer sole is provided with heel cleats of different shape than said lateral cleat but of substantially the same height.

14. A shoe in accordance with claim 13 in which the heel cleats are straight sided polygons.

15. A shoe in accordance with claim 14 in which the heel cleats include an elongated heel cleat extending laterally across the heel portion adjacent the rear of the sole and a plurality of smaller heel cleats of less cross sectional area than said elongated heel cleat positioned in front of it.

16. A shoe in accordance with claim 2 in which the lateral cleat has a convex curved front surface and a concave curved rear surface.

17. A shoe in accordance with claim 16 in which one end of the lateral cleat adjacent the inside edge of the outer sole extends substantially straight laterally and is positioned ahead of the opposite end of said lateral cleat adjacent the outside edge of said outer sole.

* * * * *